US010315885B2

(12) United States Patent
Kinnari et al.

(10) Patent No.: US 10,315,885 B2
(45) Date of Patent: Jun. 11, 2019

(54) METHOD FOR THE POSITION DETECTION OF AN ELEVATOR CAR USING AN ACCELEROMETER AND A DOOR SENSOR

(71) Applicant: KONE Corporation, Helsinki (FI)

(72) Inventors: Jouko Kinnari, Espoo (FI); Matti Laakso, Espoo (FI)

(73) Assignee: KONE CORPORATION, Helsinki (FI)

( * ) Notice: Subject to any disclaimer, the term of this patent is extended or adjusted under 35 U.S.C. 154(b) by 457 days.

(21) Appl. No.: 15/089,065

(22) Filed: Apr. 1, 2016

(65) Prior Publication Data

US 2016/0304313 A1 Oct. 20, 2016

(30) Foreign Application Priority Data

Apr. 16, 2015 (EP) ..... 15163914

(51) Int. Cl.

| | |
|---|---|
| ***B66B 3/00*** | (2006.01) |
| ***B66B 5/00*** | (2006.01) |
| ***B66B 19/00*** | (2006.01) |
| ***B66B 1/34*** | (2006.01) |

(52) U.S. Cl.

CPC ..... *B66B 5/0018* (2013.01); *B66B 1/3492* (2013.01); *B66B 5/0025* (2013.01); *B66B 19/007* (2013.01)

(58) Field of Classification Search

CPC ... B66B 5/0018; B66B 1/3492; B66B 5/0025; B66B 19/007

USPC ..... 187/247, 283, 284, 391, 393, 394, 291, 187/380–388

See application file for complete search history.

(56) References Cited

U.S. PATENT DOCUMENTS

| | | | | |
|---|---|---|---|---|
| 7,004,289 | B2 * | 2/2006 | Shrum, III | B66B 5/0037 187/393 |
| 7,073,633 | B2 * | 7/2006 | Weinberger | B66B 5/0025 187/247 |
| 7,484,598 | B2 * | 2/2009 | Tyni | B66B 5/0025 187/291 |
| 7,823,706 | B2 * | 11/2010 | Tyni | B66B 5/0031 187/391 |
| 7,958,970 | B2 * | 6/2011 | Ma | B66B 9/187 187/283 |
| 8,418,815 | B2 * | 4/2013 | Encinas Carreno | B66B 5/0006 187/247 |
| 8,678,143 | B2 * | 3/2014 | Bunter | B66B 5/0025 187/247 |

(Continued)

FOREIGN PATENT DOCUMENTS

| | | |
|---|---|---|
| EP | 2 489 621 A | 8/2012 |
| EP | 2 848 568 A1 | 3/2015 |

(Continued)

*Primary Examiner* — Anthony J Salata

(74) *Attorney, Agent, or Firm* — Birch, Stewart, Kolasch & Birch, LLP

(57) ABSTRACT

The invention concerns a method and a software program for determining the position of an elevator car moved in an elevator shaft, wherein an acceleration is measured and combined with measured open/closed states of the car door. The open-states of the door are used to identify floor-levels and a moving run sequence, wherein the car position estimate is then compared with allocated floor-levels from which the destination floor-level is calculated to extract the exact position of the car within the elevator shaft.

20 Claims, 2 Drawing Sheets

(56) References Cited

U.S. PATENT DOCUMENTS

| | | | | |
|---|---|---|---|---|
| 9,033,114 | B2 * | 5/2015 | Mizon | B66B 1/00 187/247 |
| 9,556,002 | B2 * | 1/2017 | Wilke | B66B 5/0025 |
| 9,771,243 | B2 * | 9/2017 | Kattainen | B66B 5/0031 |
| 9,950,899 | B2 * | 4/2018 | Mattsson | B66B 1/3476 |
| 2013/0283907 | A1 | 10/2013 | Kang et al. | |
| 2015/0284214 | A1 * | 10/2015 | Park | B66B 5/0018 187/393 |

FOREIGN PATENT DOCUMENTS

| | | | |
|---|---|---|---|
| EP | 2 853 511 | A1 | 4/2015 |
| JP | 2009-220904 | A | 10/2009 |
| JP | 2014-510959 | A | 5/2014 |

* cited by examiner

METHOD FOR THE POSITION DETECTION OF AN ELEVATOR CAR USING AN ACCELEROMETER AND A DOOR SENSOR

FIELD OF THE INVENTION

The present invention relates to a method and a software program carrying out the method for detecting the position of an elevator car especially in view of its actual floor-landing, the car being used for transporting persons or loads.

BACKGROUND OF THE INVENTION

There are a variety of situations in which the position of a moving component as in the present case an elevator car becomes important for a system control.

In connection with safety-relevant elevator technology it is known and it is standard practice to assign to a respective elevator car a generic sensor linked to a control unit which sensor interacts with a strip which is suitably provided on or in an elevator shaft. The strip is equipped with the typically magnetic coding, and by reading this encoding the system is able to carry out an appropriate position determination. Alternatively, such a device can be a rotary encoder, too. When a rotary encoder is used, a dented belt is preferred, because it eliminates the rope slip between the rope and the encoder pulley, which could offset the detected position value. In both cases however, the devices are time consuming in installation.

Another traditional method for getting landing information with the help of add-on sensors is to attach a number of limit switches at the elevator car such that the elevator triggers those switches when it is standing exactly at that landing. However, positioning the switches and/or the elements triggering the switches is very difficult and time-consuming, too, especially in cases where the elevator is tens of floors high.

At least, another alternative for getting landing information is to attach a distance measurement sensor such as a laser position sensor or an ultrasound transducer and to utilize distance information provided by that sensor for detecting which landing the elevator is at. However, sensors providing accurate enough information at a long enough range are typically very costly and difficult to install. Additionally, orienting the laser sensor may be difficult in a long shaft and sonar transducers are limited in range and/or suffer from undesirable reflections from components in the hoistway.

Motor control is another example scenario to determine the car position. The position information regarding motor components is useful for either controlling the motor itself, but it is also useful for determining positions of other components that move responsive to an operation of the motor. In elevator systems for example the position of the elevator car is determined by keeping the track of position information regarding the motor as this for example disclosed in JP2014510959. Many arrangements include encoders associated with the motor for purposes of determining said position information. While such arrangements have proven useful, it would be beneficial to have a lower-cost alternative to the encoder-based position determination techniques.

Further, in case of a modernization or preventive maintenance of an elevator plant only some parts have to be replaced and in a lot of cases it is even not the motor included to be exchanged so that the motor control is no solution for preventive maintenance at all.

To this end, it has been also known from document EP 2489621 A1 to use an accelerometer installed at the cabin site to determine which acceleration/deceleration the cabin has been subjected to. To this end, a mean acceleration/deceleration value is calculated which value enables a determination of the travelled distance and thus a position of the car can be calculated. However, said system does not comply with a demand of high accuracy for a position detection since a calibration can be realized solely by the highest and lowest floor-level to be served.

Aim of the Invention

The object of the invention is to provide a method for determining the position of an elevator car, especially meaning a floor level indication, which method is reliable and does not need a time consuming installation. It is especially an aim of the invention to solve the problem for determining the car position when modernizing an existing elevator system or in case of its maintenance. Further, said method is to be carried out automatically in a processor system needing therefore a software program to carry out the same.

SUMMARY OF THE INVENTION

The above object is achieved by the method according to claim 1. Advantageous embodiments are disclosed in the respective subclaims. Further, a software program carrying out the method is claimed in independent claim 12.

BRIEF DESCRIPTION OF THE SEVERAL VIEWS OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
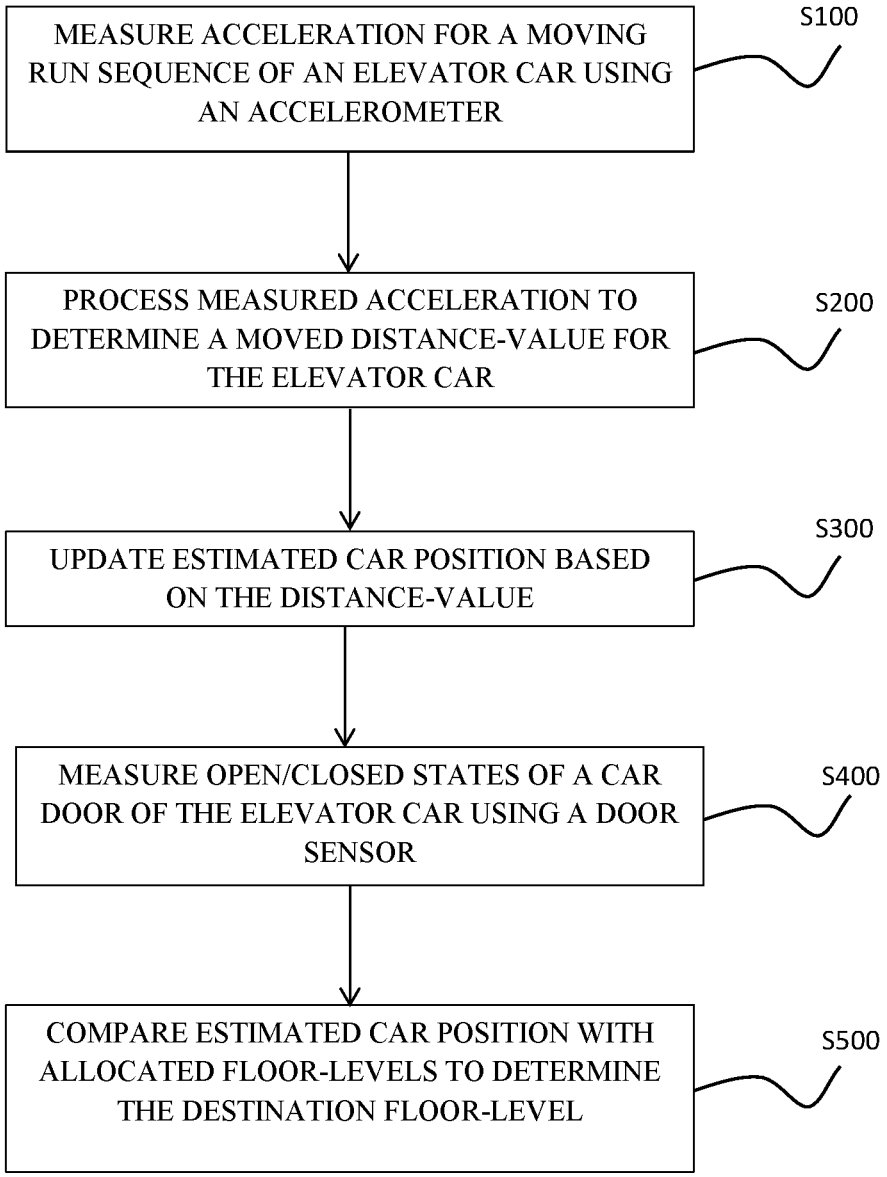
FIG. 1 shows the steps in the method for determining the position of an elevator car moved in an elevator shaft by the operation of a drive motor.
Figure 2:
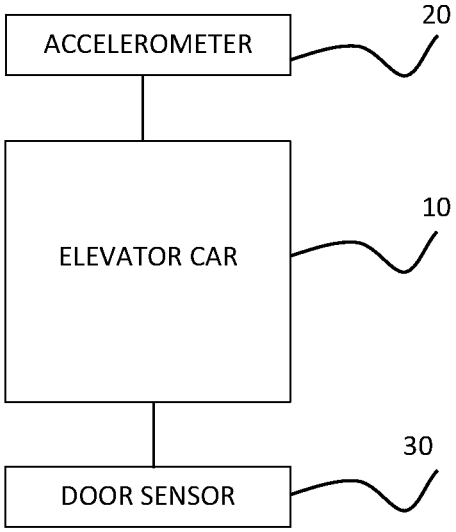
FIG. 2 is a schematic of the elevator car of FIG. 1.

As shown in FIGS. 1 and 2, a method for determining the position of an elevator car 10 moved in an elevator shaft by the operation of a drive motor includes the steps of measuring an acceleration by means of an accelerometer 20 for a moving run sequence of the car (S100), processing the acceleration in a processing unit to determine a distance-value the car moved (S200), using the distance-value the car has moved to update a car position estimate (S300), measuring open/closed states of a car door by means of a door sensor 30 (S400), wherein open-states of the door are used to identify floor-levels and the moving run sequence, sequencesequence, and comparing the car position estimate with said allocated floor-levels and determining therefrom the destination floor-level (S500), Each of these steps will be explained in greater detail below.

Basic idea of the invention is to get the landing information of an elevator car by analysing signals which can be produced by very low-cost add-on sensors, namely an accelerometer measuring acceleration, preferably the movement acceleration of the car, combined with a sensor solution providing open/closed status information about the car door or the car doors. The method described here uses an accelerometer for tracking the car position and another sensor for detecting when the doors are open.

The invention also makes it possible to use a separate analysing unit which does not feedback from elevator control and can therefore be mounted afterwards to elevator car by an individual independent maintenance company, without having to make any signal connections to the elevator control.

These above thoughts have been triggered by the need to realize a method for a car positioning determination when being confronted with a maintenance work for an existing elevator system. Such maintenance does include i.a. a so called preventive maintenance, according to which a separate analysing unit is to be implemented which does not feedback from and to the elevator control and can therefore be mounted afterwards to elevator car by a separate individual and independent maintenance company, without having to make any signal connections to the elevator control. The analysing unit may be mounted to the elevator car by an independent analysing company or maintenance company, which has not installed the elevator at first place. By means of said analysing unit data were gathered for maintenance purposes. For example, if said independent maintenance company notices with the analysing unit that doors are not functioning properly at a certain floor level, the company can send this information to the remote service centre of the maintenance company and the latter then sends a serviceman to fix the problem.

The method for determining the position of an elevator car comprises the step of measuring acceleration by means of an accelerometer for a moving run sequence of the car. Then, optionally the measured acceleration is low-pass filtered in order to reduce noise. The measured acceleration can also be high-pass filtered in order to remove the effect of gravity on the acceleration measurement.

Said acceleration function over the time—possibly filtered as described above—is then processed to calculate a distance-value the car moved over. Subsequently, the distance-value the car has moved is used to update a car position estimate.

Simultaneously with the above steps, open and closed states of a car door are sensed by means of a door sensor, wherein open-states of the door are used to identify floor-levels. From this a moving run sequence can be extracted since a single moving run sequence has to be accomplished between two open-states of a door. At least, the car position estimate is compared with said allocated floor-levels and therefrom the destination floor-level is determined.

One example for detecting a door state is to use a magnetic switch, e.g. a Reed switch, being placed in a suitable location in door operator, and a magnet is attached to a suitable moving part in the door mechanism so that the magnet is near the Reed switch when the door is fully open. However, there are also other alternatives the man skilled in the art knows about.

In view of modernizing existing elevators, the accelerometer is preferably fixed to the car. This can be accomplished in an easy way without changing any drive component.

As moreover the acceleration/deceleration value is a vector value, its direction enables to determine in which direction the elevator car travels. Based on the travelled distance and the data coming from the door sensor and identifying a floor by means of an open-state of the door, the new floor reached by the car, i.e. the destination floor can be determined.

Using an accelerometer and integrating its output twice with respect to time yields the car position according to the equation $$z(t)=z(0)+\iint_0^t dt'[a_0(t')+\Delta a(t')],$$

where $a_0(t')$ is the true acceleration, $\Delta a(t')$ the accelerometer error, consisting of noise and offset, and $z(0)$ the initial position.

The error in the accelerometer signal accumulates to an error in the calculated velocity, and from there, to an error in position. For example, with the STMicroelectronics AIS328DQ accelerometer and an elevator car travelling nominally at 1.6 meters per second, an error up to approximately one meter can accumulate for each 30 meters travelled. This error must be periodically corrected. The error in the calculated velocity can be corrected by setting it to zero when the car is known to be standing. This is realized e.g. by detecting when the doors are open. The error in the calculated position can be corrected by using the positions of the landings and optional fixed reference points.

The number and positions of the landings are unknown in advance. Instead, they are learned in an arbitrary order as the car moves.

The (inaccurate) position estimation of landings as determined by integrating the accelerometer signal is kept in an ordered computed list. When the car doors are fully open, the current position estimation is compared with the settings in the list of landings. If a landing is found in the list within a certain configurable range from the current position estimation, the landing position in the list is updated by combining both its previous value and the current estimation with certain statistical weights, for example by using a moving average. The new value for the landing position is then assigned as the current car position. If a landing with a suitable position is not found in the list, a new landing is added to the list with a position equal to the current position estimation. The floor number can be directly obtained from the list index of the landing.

In a long elevator shaft it can be necessary to include a number of additional reference points where the car position and velocity can be corrected mid-drive. Therefore, as an option, a set of fixed trigger points in the elevator shaft can be used as an advantageous embodiment for long elevators to further interpret the position information. These points can be for example magnet points, e.g. permanent magnets fixed to the elevator shaft and being read by a reed switch being mounted at the car site. In such long elevator shafts additional fixed reference points are set approximately every 30 meters. They give a signal to the elevator car when they are passed, but don't need to be positioned accurately. Shafts shorter than 30 meters don't really need any reference points. The distance of 30 meters is determined mostly based on noise characteristics of an accelerometer and can be longer still with sensors that have better noise characteristics. It is not necessary to know the number or positions of these reference points beforehand, as they can be discovered exactly like the number and positions of the landings in the manner described above.

A reference point can be passed two or more times in rapid succession in certain scenarios, e.g. a car moving up and down due to a passenger (un)loading or when it is starting and/or stopping. To keep the track of the car position correctly in these cases it is desirable to be able to distinguish between a single point triggering multiple times and multiple points triggering a single time each. This can be achieved by having alternating reference points in the shaft producing alternating types of signals, so that two or more same signals in a row can be ignored. For example, in the case of magnets, north and south poles can be used alternatingly. Another approach could be to ignore multiple triggers based on their (calculated) spatial or temporal separation.

When the car doors are fully open and the car has stopped, and if the calculated car velocity is non-zero possibly due to the accelerometer offset, this residual velocity is then used to compensate the corresponding error in the calculated position through the formula $$z_{corrected} = z - \frac{1}{2}vt,$$

where v and z are the calculated velocity and position, and t the integration time. The car velocity is then set to equal zero.

When passing a reference point, if the calculated position differs from the reference position possibly due to the accelerometer offset, this difference is then used to compensate the corresponding error in the calculated velocity through the formula $$v_{corrected} = v - 2\frac{z - z_{ref}}{t},$$

where v and z are the calculated velocity and position, and t the integration time. The car position is then set to equal the reference position.

To sum up, the invention even aims to easily mount a separate analysing device to the elevator when not being installed by the analysing or maintenance company before. When the elevator car moves in the shaft, the position estimation list is continuously updated and finally it gives a complete list of positions and floors. As electronic originals are involved, wireless transmission is possible so that no additional wiring is required. An accelerometer being mounted at the car site is connected to a data processing device via said wireless transmission then. The data processing device is provided with a transmitter-receiver in order to send and receive signals to the accelerometer. The data processing device further comprises a microprocessor and a memory.

There are significant time savings in the installation of a measurement solution such as the invention describes. Further, the invention minimizes the number of additional components needed in an elevator hoistway.

Significant cost savings compared to e.g. laser sensors are realised, too. There is no need for costly laser distance sensors, only an accelerometer and a sensor detecting the state of the door is needed, and in long hoistways, reference points in fixed locations in the hoistway and a corresponding detector in the car can be advantageously positioned.

There is no limit to the length of the elevator shaft, as long as a sufficient number of reference points are used then. There is also no need to do a separate time-consuming teaching run where the floor numbers are learned.

The position information from which the landing is extracted can then be used for e.g. monitoring the condition of components residing at that landing only (e.g. landing door), or for assessing the overall people flow performance of the elevator by tracking how many passengers went in or out at that landing.

The invention claimed is:

1. A method for determining the position of an elevator car moved in an elevator shaft by the operation of a drive motor, said method comprising the steps of:

measuring an acceleration by means of an accelerometer for a moving run sequence of the car;

processing the acceleration in a processing unit to determine a distance-value the car moved;

using the distance-value the car has moved to update a car position estimate;

measuring open/closed states of a car door by means of a door sensor, wherein open-states of the door are used to identify floor-levels and the moving run sequence; and comparing the car position estimate with said allocated floor-levels and determining therefrom the destination floor-level, wherein only the accelerometer and the door sensor are used to determine the destination floor-level.

2. The method according to claim 1, wherein the measured acceleration over the time is low-pass filtered in order to reduce noise.

3. The method according to claim 1, wherein the measured acceleration over the time is high-pass filtered in order to remove the effect of gravity on the acceleration measurement.

4. The method according to claim 1, wherein said distance-value is determined by a mathematical integration of said acceleration value over said time period of the car run.

5. The method according to claim 1, wherein a computed list of floor-levels to be served is compiled by attributing an appertaining floor indication to one of the floor-levels, respectively, wherein a specific real floor number can be directly obtained from a list index of the landing.

6. The method according to claim 5, wherein the list is periodically actualized by combining a previous level-value and the current distance-value by comparing by statistical weighing means using for example a moving average.

7. The method according to claim 1, wherein the accelerometer is installed at the car site measuring the derivation of its movement.

8. The method according to claim 1, wherein an error in accelerometer signal is corrected by setting it to zero when the door sensor indicates an open door state by means of the formula:

$$z_{corrected} = z - \frac{1}{2}vt,$$

wherein v is being calculated when the car door is open.

9. The method according to claim 1, wherein at least one further trigger point in the elevator shaft is set triggering a signal to the car when being bypassed, wherein the signal is used to enhance a calibration of the velocity data with the formula:

$$v_{corrected} = v - 2\frac{z - z_{ref}}{t},$$

where v and z are the calculated velocity and position, and t the integration time.

10. The method according to claim 9, wherein multiple trigger points are set, and wherein succeeding trigger points differ in their signal, respectively.

11. The method according to claim 10, wherein the signals differ in polarity of magnet poles.

12. A software program embodied on a non-transitory computer readable medium and realizing the method according to claim 1 when being run on a computer controller for an elevator.

13. The method according to claim 2, wherein the measured acceleration over the time is high-pass filtered in order to remove the effect of gravity on the acceleration measurement.

14. The method according to claim 2, wherein said distance-value is determined by a mathematical integration of said acceleration value over said time period of the car run.

15. The method according to claim 3, wherein said distance-value is determined by a mathematical integration of said acceleration value over said time period of the car run.

16. The method according to claim 2, wherein a computed list of floor-levels to be served is compiled by attributing an appertaining floor indication to one of the floor-levels, respectively, wherein a specific real floor number can be directly obtained from a list index of the landing.

17. The method according to claim 3, wherein a computed list of floor-levels to be served is compiled by attributing an appertaining floor indication to one of the floor-levels, respectively, wherein a specific real floor number can be directly obtained from a list index of the landing.

18. The method according to claim 4, wherein a computed list of floor-levels to be served is compiled by attributing an appertaining floor indication to one of the floor-levels, respectively, wherein a specific real floor number can be directly obtained from a list index of the landing.

19. The method according to claim 2, wherein the accelerometer is installed at the car site measuring the derivation of its movement.

20. The method according to claim 3, wherein the accelerometer is installed at the car site measuring the derivation of its movement.

* * * * *